United States Patent [19]

Sanborn et al.

[11] 4,223,537

[45] Sep. 23, 1980

[54] AIR COOLED CENTRIFUGAL WATER CHILLER WITH REFRIGERANT STORAGE MEANS

[75] Inventors: Duane F. Sanborn; Chester D. Ware, both of La Crosse, Wis.

[73] Assignee: The Trane Company, La Crosse, Wis.

[21] Appl. No.: 972,313

[22] Filed: Dec. 22, 1978

[51] Int. Cl.[3] ..... F25B 39/04; F25B 41/00

[52] U.S. Cl. ..... 62/174; 62/509

[58] Field of Search ..... 62/174, 509, 220, DIG. 17, 62/498

[56] References Cited

U.S. PATENT DOCUMENTS

| | | | |
|---|---|---|---|
| 3,191,396 | 6/1965 | Ruddock | 62/174 X |
| 3,260,067 | 7/1966 | McClure et al. | 62/505 |
| 3,857,253 | 12/1974 | Burgett et al. | 62/289 |
| 4,081,971 | 4/1978 | Eber | 62/216 |

*Primary Examiner*—William E. Wayner

*Attorney, Agent, or Firm*—Carl M. Lewis; Peter D. Ferguson

[57] ABSTRACT

An air cooled centrifugal water chiller is disclosed which may be operable (1) under conditions of low outdoor ambient temperature, requiring flooding of the air cooled condenser in order to reduce its capacity and maintain proper system operation; or (2) in a heat recovery mode through the provision of a liquid cooled heat recovery condenser which thereby accommodates a portion of or all the condensing load, also requiring reduction in the capacity of the air cooled condenser through flooding. In order to provide sufficient refrigerant within the system to accommodate flooding under the conditions enumerated above, a refrigerant storage vessel is provided in communication with the shell of the evaporator of the system for receiving and storing excess liquid refrigerant during those operating conditions when it is not required in order to flood the air cooled condenser. An added feature lies in the provision of suitable service valves for isolating the air cooled condenser and the refrigerant storage vessel from the evaporator and centrifugal compressor such that liquid refrigerant from the evaporator may be pumped into the refrigerant storage vessel in order to allow servicing of the compressor or evaporator. In a preferred embodiment, the refrigerant storage vessel comprises an elongated pipe member connected at one end to the evaporator shell and extending therefrom along an axis generally parallel to the longitudinal extent of the air cooled condenser.

11 Claims, 1 Drawing Figure

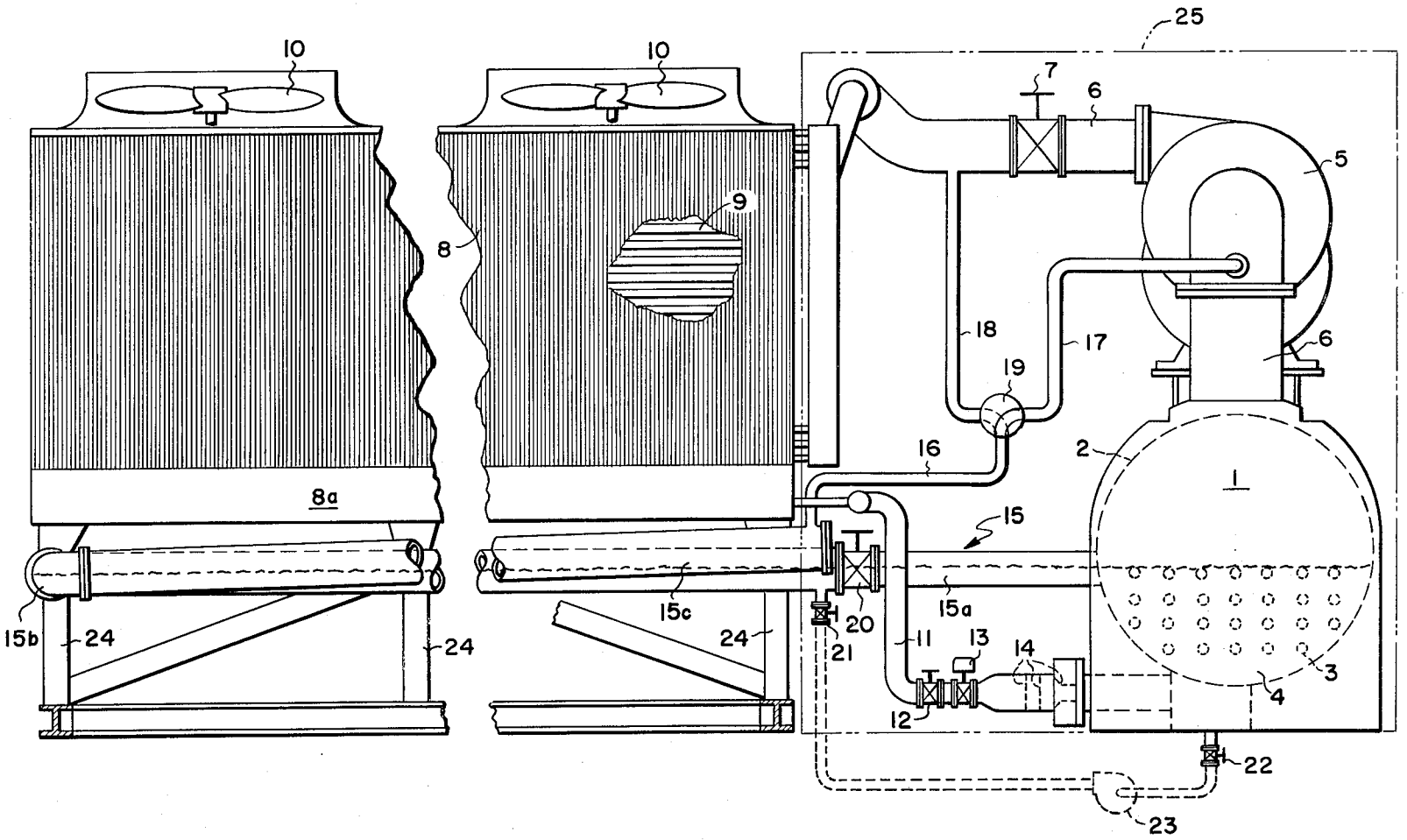
1
2
3
4
5
6
7
8
8a
9
10
11
12
13
14
15
15a
15b
15c
16
17
18
19
20
21
22
23
24
25

AIR COOLED CENTRIFUGAL WATER CHILLER WITH REFRIGERANT STORAGE MEANS

DESCRIPTION

TECHNICAL FIELD

The present invention relates generally to centrifugal water chillers of the type designed to produce relatively large quantities of chilled liquid for applications such as building air conditioning, and is specifically directed to a centrifugal water chiller of the type which includes an air cooled condenser in lieu of the more common water cooled type and which is further operable under conditions of low outdoor ambient temperature, or in heat recovery applications wherein a portion of the condensing load is utilized to produce a heated liquid.

BACKGROUND ART

Air cooled centrifugal water chillers per se are known in the art, as exemplified by U.S. Pat. No. 3,857,253. Prior attempts to operate chillers of this type under low outdoor ambient conditions, however, have not relied upon flooding of the air cooled condenser in order to reduce its capacity at the low outdoor ambient temperatures and, instead, a selectively operable refrigerant pump has been provided between the air cooled condenser and evaporator in order to insure the passage of refrigerant therebetween at low ambients.

In U.S. patent application Ser. No. 972,309, filed concurrently herewith, in the names of Mark O. Bergman, John W. Leary, Duane F. Sanborn, and Chester D. Ware, which application is commonly assigned with the present application, an air cooled centrifugal water chiller is disclosed which includes a water cooled heat recovery condenser for the production of a heated liquid. In the system disclosed therein, the evaporator shell is simply made sufficiently large to hold the quantity of refrigerant required to flood the air cooled condenser during full heat recovery operation. The subject matter of said application is hereby incorporated herein.

DISCLOSURE OF THE INVENTION

In accordance with the present invention, an air cooled centrifugal water chiller is provided which includes evaporator means comprising a shell for containing a quantity of liquid refrigerant and including a plurality of tubes passing therethrough in heat exchange relationship with said refrigerant, whereby a heat exchange medium may be passed through the tubes and chilled through vaporization of the refrigerant, thereby producing a relatively low pressure vaporized refrigerant. Centrifugal compressor means are connected to the evaporator means to receive the vaporized refrigerant and compress same in order to produce a relatively high pressure vaporized refrigerant.

Air cooled condenser means are connected to the centrifugal compressor means via first conduit means and receive the high pressure vaporized refrigerant, condensing same by heat exchange with a source of air. The air cooled condenser means comprises a plurality of finned tubes within which the refrigerant condenses and over which air passes in heat exchange relationship. Thus, the capacity of the air cooled condenser means may be reduced under predetermined operating conditions through the flooding of said tubes with condensed refrigerant to thereby reduce their heat exchange capacity. The condensed refrigerant passes via second conduit means from the air cooled condenser means to the evaporator means, expansion means being provided for reducing the pressure of the condensed refrigerant prior to its admission to the evaporator means.

In order to store excess liquid refrigerant during those operating conditions when such refrigerant is not required in order to flood the air cooled condenser means, a liquid refrigerant storage vessel is provided in communication with the shell of the evaporator means for receiving therefrom and storing such excess liquid refrigerant. In order to insure proper operation of this storage vessel under all operating conditions, first vent conduit means are provided communicating between the storage vessel and a point in the refrigeration system in communication with the aforesaid relatively low pressure vaporized refrigerant.

The refrigerant storage vessel may also be used in order to store liquid refrigerant during those times that the low pressure side of the refrigeration system; e.g., the evaporator means and compressor means, may require servicing. To this end, first and second valve means are disposed in the respective first and second conduit means for selectively isolating the air cooled condenser means and third valve means are provided for blocking communication between the shell of the evaporator means and the liquid refrigerant storage vessel. Second vent conduit means provide selective communication between the refrigerant storage vessel and an upper portion of the condenser means. In this manner, through the provision of suitable refrigerant flow connections on the storage vessel and evaporator means, an externally supplied pump may be connected therebetween for the transfer of liquid refrigerant from the evaporator means to the storage vessel, thereby allowing servicing of the evaporator means or centrifugal compressor means.

In the preferred embodiment, the refrigerant storage vessel comprises an elongated pipe member connected at one end to the shell of the evaporator means and extending therefrom along an axis parallel to a longitudinally extending axis of the air cooled condenser means. Preferably, the air cooled condenser means is elevated by suitable support members and the elongated pipe member is disposed there below.

Accordingly, it is the primary object of the present invention to provide an air cooled centrifugal water chiller wherein provision is made for storing excess liquid refrigerant so as to enable the system to operate at low outdoor ambient temperatures or in a heat recovery mode.

It is a further object of the invention to provide such a system wherein the refrigerant storage vessel provided is economical to manufacture and of a design which is compatible with the overall arrangement of the components making up the refrigeration system.

Yet a further object of the invention is the provision of suitable valve means for isolating the air cooled condenser means of the system and the refrigerant storage vessel so as to permit its use for storing liquid refrigerant while service operations are performed on the evaporator means or compressor means.

These and other objects of the present invention will become apparent hereinafter wherein the best mode of carrying out the invention is disclosed with reference to the appended drawing.

BRIEF DESCRIPTION OF THE DRAWING

The FIGURE illustrates a refrigeration system comprising an air cooled centrifugal water chiller with refrigerant storage means constructed according to the present invention.

BEST MODE FOR CARRYING OUT THE INVENTION

As seen in the Figure, the refrigeration system of the present invention comprises evaporator means 1 which are of the conventional shell-and-tube type, including a generally cylindrical shell 2 having a plurality of tubes 3 passing therethrough. As shown, tubes 3 are in heat exchange relationship to a quantity of liquid refrigerant 4 which is contained within the shell. A heat exchange medium is passed through the tubes and chilled through vaporization of the refrigerant, thereby producing a relatively low pressure vaporized refrigerant.

Centrifugal compressor means 5 are disposed adjacent to and, in the preferred embodiment, mounted directly atop evaporator means 2, being connected thereto by conduit 6 for the receipt of relatively low pressure vaporized refrigerant. In the preferred embodiment, centrifugal compressor means 5 comprise the type which is driven by an electric motor through a set of gears whereby relatively high rotational speeds are achieved. With this type compressor means, a preferred refrigerant for use in the system would be R-12.

Compressed, relatively high pressure vaporized refrigerant leaves centrifugal compressor means 5 via first conduit means 6, through first valve means 7, to air cooled condenser means 8 to be condensed by heat exchange with a source of air. To this end, air cooled condenser means 8 (shown broken away to indicate that its length may vary) comprises an elongated assembly of finned tubes, indicated diagrammatically at 9, within which refrigerant condenses and over which air passes in heat exchange relationship, being drawn thereover by fan means 10. Condenser means 8 include a lower subcooler section indicated at 8*a* which serves to further reduce the temperature of condensed refrigerant to a level below that corresponding to its saturation pressure. As shown, condenser means 8 is elevated by a plurality of support members 24.

Condensed refrigerant exits condenser means 8 via second conduit means 11, through second valve means 12, normally open control valve 13 and expansion means 14 before being returned to the sump of evaporator means 2. Expansion means 14 comprise a plurality of orifice plates and an expansion nozzle, as disclosed more fully in U.S. Pat. No. 3,260,067, and serve to reduce the pressure of the condensed refrigerant prior to its admission to evaporator means 2.

As will be appreciated by those skilled in the art, it may be desirable under certain operating conditions of the refrigeration system that the capacity of air cooled condenser means 8 be reduced. For example, when air cooled condenser means 8 is exposed to low outdoor ambient conditions, the refrigerant pressure therein will be correspondingly reduced to a level which may be inadequate to insure proper refrigerant flow from the condenser to evaporator means 2. As a result, refrigerant will build up or "flood" within condenser means 8, thereby flooding the interiors of tubes 9 with liquid refrigerant and reducing their heat exchange capacity. This will continue until a refrigerant temperature and pressure are achieved leaving the condenser that will permit the required refrigerant flow. In this manner, proper operation of the system may be maintained at low outdoor ambient temperatures.

It will be further appreciated that, in order to operate the system as described in the previous paragraph, the refrigeration system itself must contain a sufficient quantity of refrigerant as to effect the desired degree of flooding within air cooled condenser means 8 without reducing the refrigerant level within the evaporator below a minimum required for safe operation; e.g., one at which adequate evaporator temperature and pressure is maintained to avoid freeze-up therein or surge of refrigerant through compressor 5. More particularly, the system must be provided with sufficient storage capacity as to accommodate this excess refrigerant during operation at high ambient temperatures when full capacity f air cooled condenser means 8 is required. It is this requirement to which the present invention addresses itself.

Looking then to the FIGURE, it will be seen that a refrigerant storage vessel is provided in the form of an elongated pipe member indicated generally by reference numeral 15 and which includes a first section 15*a* connected to shell 2 of evaporator means 1 and in communication therewith so as to receive liquid refrigerant, which first section extends longitudinally from shell 2 along an axis generally parallel to the longitudinal extent or axis of air cooled condenser means 8. First section 15*a* connects with a U-shaped returned bend section 15*b* which, in turn, is connected to a return section 15*c* which extends longitudinally back toward evaporator means 2. Preferably, the elongated pipe member comprising refrigerant storage vessel 15 is slightly inclined continuously in a direction away from the point at which it connects to evaporator means 1 in order to promote the flow of liquid refrigerant therefrom into evaporator means 1. The exterior of refrigerant storage vessel 15 will be covered with a layer of insulating material so as to minimize heat transfer from the ambient to refrigerant contained therein.

As is apparent from the FIGURE, refrigerant storage vessel 15 is operative to receive liquid refrigerant from shell 2 of evaporator means 1 as soon as the level therein rises above the low point at which section 15*a* is connected to the shell. As the refrigerant level within the shell rises from this low point, storage vessel 15 will continue to receive excess refrigerant until the level reaches the upper connection point of section 15*a*, at which point storage vessel 15 will be substantially full. Accordingly, storage vessel 15 is sized and located such that, when the capacity of air cooled condenser means is reduced to a maximum extent; e.g., it contains a maximum amount of refrigerant, the refrigerant level within shell 2 will be approximately at the lowermost connection point of pipe section 15*a*, thereby preventing the development of excessively low pressures within the evaporator. Similarly, during those times when the capacity of air cooled condenser means 8 is at its maximum, the effective level of liquid refrigerant within the evaporator means 1 will be approximately at the highest point at which pipe section 15*a* connects thereto, such that refrigerant storage vessel 15 will contain its maximum amount of excess refrigerant. At this operating condition, the level of liquid refrigerant within evaporator 1 will be maintaind at a safe level such that excessive liquid is not entrained with the vapor passing to compressor 5, a condition which would cause damage to the moving parts thereof.

In order to insure proper refrigerant flow into and out of refrigerant storage vessel 15, first vent conduit means comprising first conduit 16, two-way valve 19, and second conduit 17 are provided for effecting communication between the refrigerant storage vessel and a point in the refrigeration system in communication with relatively low pressure vaporized refrigerant. As shown, this point preferably comprises the inlet to centrifugal compressor means 5 although such point could also be located in the upper portion of evaporator shell 2 without departing from the scope of the invention. The vent conduit means serve to remove any rapor which may be generated within refrigerant storage vessel 15 during operation under high ambient conditions, it being appreciated that the refrigerant stored therein is at essentially evaporator temperature and pressure such that heat from the ambient conducted through the walls of vessel 15 would vaporize same. The removal of such vapor further serves to enhance and maintain the liquid storage capcity of vessel 15. A second operating advantage of the vent conduit means is realized during start-up of the system when the refrigerant within storage vessel 15 is at a relatively high temperature, as is the mass of vessel 15, both of which must be lowered to the operating evaporating temperature. Under these conditions, a relatively large amount of liquid refrigerant within vessel 15 will flash and must be removed, least it force an excess amount of liquid out of vessel 15 and into evaporator 1. The vent conduit means shown has provied to solve this problem.

An additional function served by refrigerant storage vessel 15 may be realized through the provision of first valve means 7 and second valve means 12 whereby air cooled condenser means 8 may be isolated from evaporator means 1 and centrifugal compressor means 5; and the provision of third valve means 20 which blocks communication between the shell of evaporator means 1 and liquid refrigerant storage vessel 15. In this manner, an externally supplied pump 23 may be conduitconnected between first and second refrigerant flow connections 21 and 22 for the transfer of liquid refrigerant from evaporator means 1 to refrigerant storage vessel 15, thereby permitting servicing of evaporator means 1 or centrifugal compressor means 5. During operation in this mode, it is desirable that refrigerant storage vessel 15 be vented via second vent conduit means to an upper portion of air cooled condenser means 5 and, to carry this out, two-way valve 19 is moved so as to provide communication between first conduit 16 and third conduit 18, the latter of which is connected to first conduit means 6 in communication with the upper portion of condenser means 8.

In order to prevent freezing conditions from occurring within evaporator means 1 during those times that the refrigeration system is shut down and air cooled condenser means 8 is exposed to low ambient temperature, control valve 13 is provided to block communication between air cooled condenser means 8 and evaporator means 1 during shutdown, as more fully disclosed and described in U.S. Pat. No. 4,081,971. Reference may also be had to commonly assigned, copending U.S. Patent application Ser. No. 972,310, filed Dec. 22, 1978, in the names of John W. Leary, Mark O. Bergman, and John L. Honeck wherein alternative freeze prevention means are disclosed in the form of an inverted U-tube between the condenser and evaporator for blocking refrigerant flow during shut down.

As more fully described in U.S. Pat. No. 3,857,253, the compressor means and evaporator means are housed within a suitable weather-resistant enclosure, indicated diagrammatically at 25.

It will thus be appreciated that refrigerant storage vessel 15 serves to store excess liquid refrigerant within the refrigeration system during those times that it is not needed in order to flood air cooled condenser means 8 and thereby reduce its capacity. This scheme has proven to be a more cost effective method of providing the required storage capacity than simply providing an evaporator shell itself having the requisite capacity. Moreover, as described above, this scheme permits the use of refrigerant storage vessel 15 for storing liquid refrigerant during servicing of the machine.

It should further be pointed out that refrigerant storage vessel 15 has application in conjunction not only with a machine which is to be operated under low outdoor ambient conditions, as described above, but also in conjunction with a system having heat recovery capability, wherein the capacity of the air cooled condenser must be reduced during those times when heat recovery is being carried out. Reference may be had to the above copending, commonly assigned application for an understanding of such a system.

While the invention has been described with respect to a preferred embodiment, it is to be understood that modifications thereto will be apparent to those skilled in the art within the scope of the invention, as defined in the claims which follow.

We claim:

1. A refrigeration system comprising a. evaporator means comprising a shell for containing a quantity of liquid refrigerant and including a plurality of tubes passing therethrough in heat exchange relationship with said refrigerant, whereby a heat exchange medium may be passed through said tubes and chilled through vaporization of said refrigerant, thereby producing a relatively low pressure vaporized refrigerant;

b. centrifugal compressor means connected to said evaporator means for receiving said relatively low pressure vaporized refrigerant and compressing same, thereby producing a relatively high pressure vaporized refrigerant;

c. air cooled condenser means connected to said centrifugal compressor means via first conduit means for receiving said relatively high pressure vaporized refrigerant and condensing same by heat exchange with a source of air, said air cooled condenser means comprising an elongated assembly including a plurality of finned tubes within which said refrigerant condenses and over which said air passes in heat exchange relationship, said elongated assembly being disposed adjacent said evaporator means and extending therefrom along a longitudinal axis; the capacity of said air cooled condenser means being selectively reduced under predetermined operating conditions through the flooding of said tubes with condensed refrigerant to thereby reduce their heat exchange capacity;

d. second conduit means for passing condensed refrigerant from said air cooled condenser means to said evaporator means, including expansion means for reducing the pressure of said condensed refrigerant prior to its admission to said evaporator means; and c. a liquid refrigerant storage vessel in communication with the shell of said evaporator means for receiving therefrom and storing excess liquid refrigerant during those operating conditions when such refrigerant is not required in order to flood and thereby reduce the capacity of said air cooled condenser means as recited in paragraph (c.) and for returning same to the refrigeration system when so required, said refrigerant storage vessel comprising an elongated pipe member connected at one end to said shell and extending therefrom along an axis generally parallel to said longitudinal axis and adjacent said air cooled condenser means.

2. The refrigeration system of claim 1 further comprising first vent conduit means for providing communication between said storage vessel and a point in said refrigeration system in communication with said relatively low pressure vaporized refrigerant.

3. The refrigeration system of claims 1, or 2 wherein said air cooled condenser means is elevated by support members and said elongated pipe member is disposed therebelow.

4. The refrigeration system of claim 3 wherein said elongated pipe member is of generally U-shaped configuration, including a first section extending longitudinally as aforesaid from said shell, a return bend section disposed adjacent the longitudinal end of said air cooled condenser means, and a return section extending back toward said evaporator means, said first and return sections being slightly inclined upwardly so as to promote refrigerant flow therefrom into the shell of said evaporator means; said vent conduit means being in communication with the end of said return section.

5. The refrigeration system of claims 1 or 2 wherein said elongated pipe member is connected to said shell at a level approximating the desired level of refrigerant therein.

6. A refrigeration system comprising a. evaporator means comprising a shell for containing a quantity of liquid refrigerant and including a plurality of tubes passing therethrough in heat exchange relationship with said refrigerant, whereby a heat exchange medium may be passed through said tubes and chilled through vaporization of said refrigerant, thereby producing a relatively low pressure vaporized refrigerant;

b. centrifugal compressor means connected to said evaporator means for receiving said relatively low pressure vaporized refrigerant and compressing same, thereby producing a relatively high pressure vaporized refrigerant;

c. air cooled condenser means connected to said centrifugal compressor means via first conduit means for receiving said relatively high pressure vaporized refrigerant and condensing same by heat exchange with a source of air, said air cooled condenser means comprising a plurality of finned tubes within which said refrigerant condenses and over which said air passes in heat exchange relationship; the capacity of said air cooled condenser means being selectively reduced under predetermined operating conditions through the flooding of said tubes with condensed refrigerant to thereby reduce their heat exchange capacity;

d. second conduit means for passing condensed refrigerant from said air cooled condenser means to said evaporator means, including expansion means for reducing the pressure of said condensed refrigerant prior to its admission to said evaporator means; and e. a liquid refrigerant storage vessel in communication with the shell of said evaporator means for receiving therefrom and storing excess liquid refrigerant during those operating conditions when such refrigerant is not required in order to flood and thereby reduce the capacity of said air cooled condenser means as recited in paragraph (c.) and for returning same to the refrigeration system when so required, said liquid refrigerant storage vessel being in communication with the shell of said evaporator means at a point such that, as the refrigerant level rises within the shell above a predetermined minimum, a portion thereof will flow into said storage vessel, the refrigerant level within said vessel varying with that within the evaporator shell above said predetermined minimum.

7. The refrigeration system of claim 6 wherein said air cooled condenser means comprise an elongated assembly of said finned tubes disposed adjacent said evaporator means and extending therefrom along a longitudinal axis and wherein said refrigerant storage vessel comprises an elongated pipe member connected at one end to said shell and extending therefrom along an axis generally parallel to said longitudinal axis and adjacent said air cooled condenser means.

8. A refrigeration system comprising a. evaporator means comprising a shell for containing a quantity of liquid refrigerant and including a plurality of tubes passing therethrough in heat exchange relationship with said refrigernat, whereby a heat exchange medium may be passed through said tubes and chilled through vaporization of said refrigerant, thereby producing a relatively low pressure vaporized refrigerant;

b. centrifugal compressor means connected to said evaporator means for receiving said relatively low pressure vaporized refrigerant and compressing same, thereby producing a relatively high pressure vaporized refrigerant;

c. air cooled condenser means connected to said centrifugal compressor means via first conduit means for receiving said relatively high pressure vaporized refrigerant and condensing same by heat exchange with a source of air, said air cooled condenser means comprising a plurality of finned tubes within which said refrigerant condenses and over which said air passes in heat exchange relationship; the capacity of said air cooled condenser means being selectively reduced under predetermined operating conditions through the flooding of said tubes with condensed refrigerant to thereby reduce their heat exchange capacity;

d. second conduit means for passing condensed refrigerant from said air cooled condenser means to said evaporator means, including expansion means for reducing the pressure of said condensed refrigerant prior to its admission to said evaporator means;

e. a liquid refrigerant storage vessel in communication with the shell of said evaporator means for receiving therefrom and storing excess liquid refrigerant during those operating conditions when such refrigerant is not required in order to flood and thereby reduce the capacity of said air cooled condenser means as recited in paragraph (c.) and for returning same to the refrigeration system when so required;

f. first and second valve means disposed in said respective first and second conduit means for selectively isolating said air cooled condenser means from said centrifugal compressor means and said evaporator means;

g. third valve means for selectively blocking said communication between the shell of said evaporator means and said liquid refrigerant storage vessel;

h. second vent conduit means for providing selective communication between said refrigerant storage vessel and an upper portion of said air cooled condenser means; and i. first and second refrigerant flow connections associated with the respective refrigerant storage vessel and evaporator means whereby a pump may be connected therebetween for the transfer of liquid refrigerant from said evaporator means to said refrigerant storage vessel when said first, second, and third valve means are in their closed positions and said second vent conduit means provides communication between said refrigerant storage vessel and an upper portion of said air cooled condenser means, thereby permitting storage of said liquid refrigerant during servicing of said evaporator means or said centrifugal compressor means.

9. The refrigeration system of claim 8 further comprising first vent conduit means for providing communication between said storage vessel and a point in said refrigeration system in communication with said relatively low pressure vaporized refrigerant.

10. The refrigeration system of claim 9 wherein said first and second vent conduit means comprise a. a first conduit connected to said refrigerant storage vessel;

b. a second conduit connected between said first conduit and said point in said refrigeration system in communication with relatively low pressure vaporized refrigerant;

c. a third conduit connected between said first conduit and a point in said system in communication with an upper portion of said air cooled condenser means; and d. valve means for providing selective communication between said first and second conduits or between said first and third conduits.

11. The refrigeration system of claim 10 wherein said valve means comprise a two-way valve having an inlet connected to said first conduit and first and second outlets connected to said respective second and third conduits.

* * * * *

UNITED STATES PATENT AND TRADEMARK OFFICE

CERTIFICATE OF CORRECTION

PATENT NO. : 4,223,537

DATED : September 23, 1980

INVENTOR(S) : Duane F. Sanborn and Chester D. Ware

It is certified that error appears in the above-identified patent and that said Letters Patent are hereby corrected as shown below:

Claim 3, line 1, change "1, or 2" to --1, 2, or 7--.

Signed and Sealed this

*Twenty-third* Day of *December 1980*

[SEAL]

*Attest:*

SIDNEY A. DIAMOND

*Attesting Officer*

*Commissioner of Patents and Trademarks*